US007933532B2

(12) United States Patent
Adams et al.

(10) Patent No.: US 7,933,532 B2
(45) Date of Patent: Apr. 26, 2011

(54) METHOD AND APPARATUS FOR GENERATING A SPREAD SPECTRUM SIGNAL IN A PRINTER POWER SUPPLY UNIT

(75) Inventors: Jerry F. Adams, Waterport, NY (US); William R. Harris, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 469 days.

(21) Appl. No.: 12/118,215

(22) Filed: May 9, 2008

(65) Prior Publication Data

US 2009/0279915 A1 Nov. 12, 2009

(51) Int. Cl.
*G03G 15/00* (2006.01)

(52) U.S. Cl. ..... 399/88

(58) Field of Classification Search ..... 399/88
See application file for complete search history.

(56) References Cited

U.S. PATENT DOCUMENTS 5,831,728 A * 11/1998 Malczewski et al. ..... 356/316
5,952,892 A * 9/1999 Szajda ..... 331/57
2006/0093388 A1* 5/2006 Kawazu et al. ..... 399/69
2008/0129264 A1* 6/2008 Moussaoui et al. ..... 323/283
2009/0002520 A1* 1/2009 Yoshida et al. ..... 348/226.1

FOREIGN PATENT DOCUMENTS

JP 2007318654 A * 12/2007

* cited by examiner

*Primary Examiner* — Quana M Grainger
(74) *Attorney, Agent, or Firm* — Ronald E. Prass, Jr.; Prass LLP

(57) ABSTRACT

A method and apparatus that generates a spread spectrum signal in a printer power supply unit is disclosed. The method may include receiving an enable signal to power on the printer power supply unit, generating an initial power signal for the printer power supply unit based on the signal received from the power supply controller, the initial power signal being generated in a predetermined frequency range around a predetermined center frequency value, powering on the printer power supply unit using the generated initial power signal, repeatedly updating the initial power signal, wherein the updated power signal has a frequency value in the predetermined frequency range and the predetermined center frequency value is maintained, and powering the printer power supply unit using the updated power signal.

21 Claims, 5 Drawing Sheets

METHOD AND APPARATUS FOR GENERATING A SPREAD SPECTRUM SIGNAL IN A PRINTER POWER SUPPLY UNIT

BACKGROUND

Disclosed herein are a method and apparatus for generating a spread spectrum signal in a printer power supply unit, as well as corresponding apparatus and computer-readable medium.

In many print engines, alternating current (AC) driven corona devices are employed because they provide very good charge uniformity. They have historically been driven with a 4 KHz high voltage AC source, which was chosen as a good compromise between the potential for creating image quality problems at low frequencies and increasing reactive power demands at higher frequencies.

One problem with the use of these devices has been the audible noise they generate. The 4 KHz signal falls well within the frequency range of the hearing of most people, and the more devices that are employed, the more annoying the audible noise can be to others. In addition, two other potential problems that can be associated with these devices are the possibility of producing image quality artifacts, even at 4 KHz, and the ubiquitous presence of electromagnetic (E/M) emissions which are concentrated at high harmonics of the fundamental frequency.

SUMMARY

A method and apparatus that generates a spread spectrum signal in a printer power supply unit is disclosed. The method may include receiving an enable signal to power on the printer power supply unit, generating an initial power signal for the printer power supply unit based on the signal received from the power supply controller, the initial power signal being generated in a predetermined frequency range around a predetermined center frequency value, powering on the printer power supply unit using the generated initial power signal, repeatedly updating the initial power signal, wherein the updated power signal has a frequency value in the predetermined frequency range and the predetermined center frequency value is maintained, and powering the printer power supply unit using the updated power signal.

DETAILED DESCRIPTION

Figure 1:
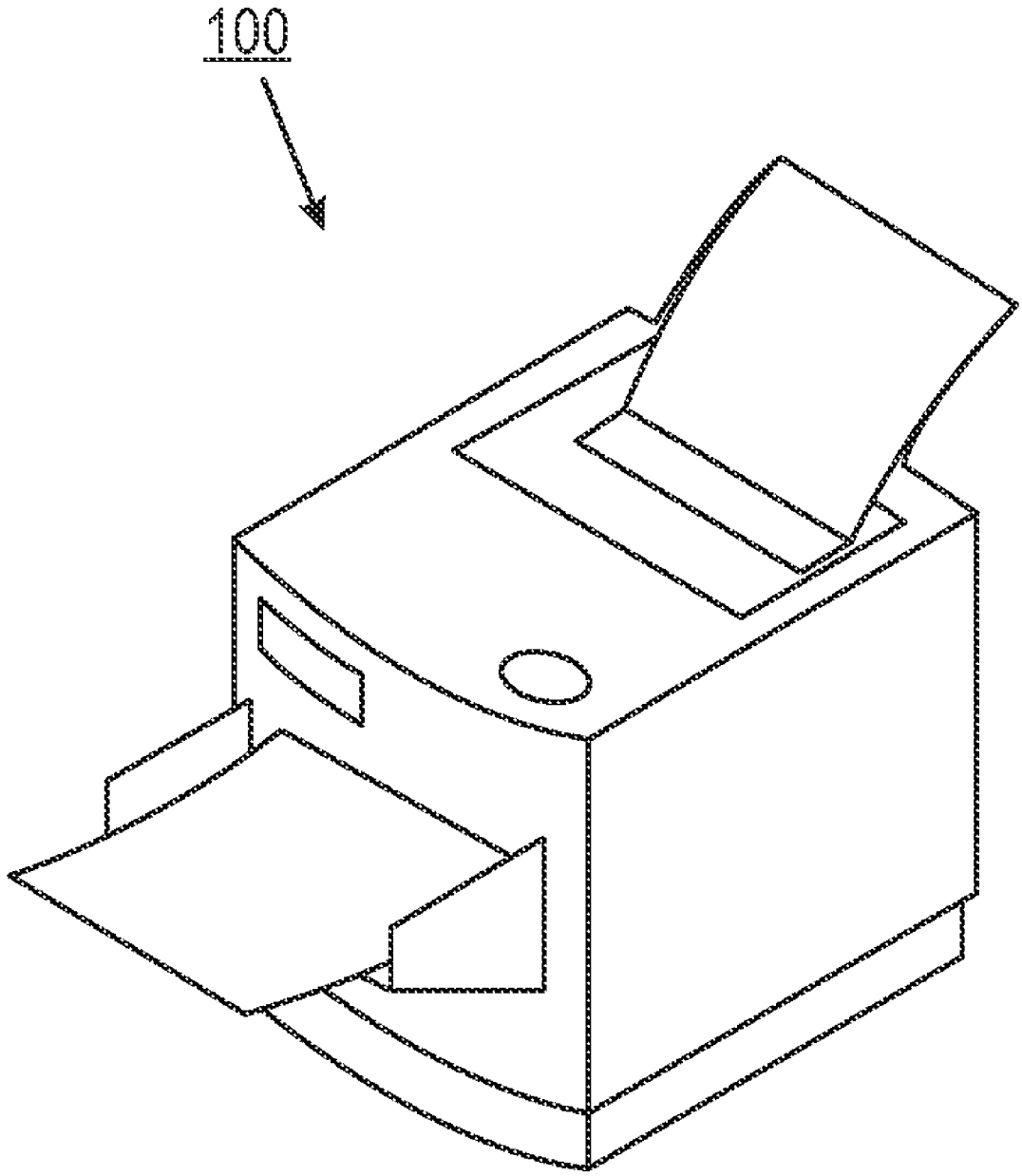
FIG. 1 illustrates an exemplary diagram of a printer in accordance with one possible embodiment of the disclosure.

Aspects of the embodiments disclosed herein relate to a method for generating a spread spectrum signal in a printer power supply unit, and corresponding apparatus and computer readable medium. The disclosed embodiments may concern a method and apparatus for generating a spread spectrum signal in a printer power supply unit, as well as corresponding apparatus and computer-readable medium.

The disclosed embodiments may include a method for generating a spread spectrum signal in a printer power supply unit. The method may include receiving an enable signal to power on the printer power supply unit, generating an initial power signal for the printer power supply unit based on the signal received from the power supply controller, the initial power signal being generated in a predetermined frequency range around a predetermined center frequency value, powering on the printer power supply unit using the generated initial power signal, repeatedly updating the initial power signal, wherein the updated power signal has a frequency value in the predetermined frequency range and the predetermined center frequency value is maintained, and powering the printer power supply unit using the updated power signal.

The disclosed embodiments further include an apparatus that generates a spread spectrum signal in a printer power supply unit. The apparatus may include a power supply controller that receives an enable signal to power on the printer power supply unit, and a signal generator that generates an initial power signal for the printer power supply unit based on the signal received from the power supply controller, the initial power signal being generated in a predetermined range around a predetermined center frequency value provided by the power supply controller, powering on the printer power supply unit using the generated initial power signal. The power supply controller repeatedly updates the initial power signal, the updated power signal having a frequency in the predetermined range and the predetermined center frequency value is maintained, and the signal generator powers the printer power supply unit using the updated power signal.

The disclosed embodiments further include a computer-readable medium that stores instructions for controlling a computing device for generating a spread spectrum signal in a printer power supply unit. The instructions may include receiving an enable signal to power on the printer power supply unit, generating an initial power signal for the printer power supply unit based on the signal received from the power supply controller, the initial power signal being generated in a predetermined frequency range around a predetermined center frequency value, powering on the printer power supply unit using the generated initial power signal, repeatedly updating the initial power signal, wherein the updated power signal has a frequency value in the predetermined frequency range and the predetermined center frequency value is maintained, and powering the printer power supply unit using the updated power signal.

This disclosure proposes the replacement of the traditional monotonic (i.e. an unvarying single frequency) 4 KHz signal generator from which the High Voltage (HV) Alternating Current (AC) signal may be derived with a spread spectrum generator whose center frequency value is 4 KHz. This type of generator may provide the same total power as a monotonic source, but it may be spread over a well-controlled bandwidth with an approximately uniform distribution (vs. a normal distribution), for example. The power signal may be randomly generated within the frequency range, for example. In doing so, the corona device may continue to receive all the power of a traditional power supply, but the peak power observed in the frequency domain may be significantly reduced.

Spread spectrum is a technique originally developed to reduce the peak power emitted by certain radio transmission systems. The process may replace a very narrow bandwidth generator with one with a broader bandwidth that has a uniform distribution of signal strength across the band (as compared to one with a normal distribution.) This technique may allow one to generate and transmit the same total net power over the band while significantly reducing the power at any one frequency.

In replacing the 4 KHz monotonic signal source with a spread spectrum type source, the signal driving the device, rather than being a narrowly focused 4 KHz signal, may instead be smeared over a predetermined frequency band, say about 3.8 KHZ to about 4.2 KHZ. Keeping the drive voltage the same, the total power delivered to the device may remain constant. However, when the power is observed in the frequency domain, the power at any one frequency may be greatly reduced.

This technique may significantly reduce the audible emission at any one frequency and would further severely reduce the perceived audible noise level associated with multiple AC corona devices. An additional audible benefit may be realized on machines where multiple 4 KHZ AC devices are used, for example. Often in such cases, the most annoying audible feature may not be the 4 KHZ tone itself, but the beat frequencies that are created due to slight differences in frequency between different devices. These beat frequencies may be all but eliminated by using a spread spectrum signal.

Also, by replacing the monotonic AC signal with a random signal within a controlled bandwidth, image quality artifacts due to the AC nature of the corona generating source, if present, may also be far less noticeable since perception of these defects may be largely influenced by the recognition of patterns. This process may in turn allow for lower frequency operation, and therefore lower power dissipation in the High Voltage Power Supply (HVPS), without noticeable Image Quality IQ) degradation.

This benefit to voltage uniformity and IQ may be magnified on a system where there are actually multiple discorotrons per station. With a single discorotron, this concept would count on the wide "footprint" of each corona device to allow multiple frequencies to have an effect on any given point on the Photoreceptor (PR). However, with three devices, for example, each point on the PR would be exposed to three times (roughly—some frequencies would probably be repeated) the frequencies that a single discorotron may provide while that point were inside the footprint of the discorotron.

Finally, to reduce E/M emissions, one may expect improvements in emissions from the charge, transfer/detack, preclean and other AC driven corona subsystems that employ this technique. Simply by radiating the same power level, but spreading it over a range of frequencies, the peak radiated power at any one frequency may be lowered.

A spread spectrum signal may be generated in many ways. But given the fairly lazy 4 KHz center frequency value, the recommended manner may be by employing a digital embedded controller. A microcontroller process may be used, for example. First, a look-up table may be constructed to slice up a sine wave into 20 pieces or so, for example. Then, a clock generator may be used to sequence through the look-up table. The clock generator may have a period based on a timer that may be updated once per trip through the look-up table. The updated frequency value may be based on a constrained random or pseudo-random number such that the program may cycle through the look-up table's 20 positions in anywhere from $1/3800$ to $1/4200$ seconds.

A low-pass filter may be placed on the reconstructed sine wave output signal to smooth it and to remove any clues to the discrete nature of the signal. This process may result in a sine wave signal in which each full cycle would be of a unique frequency from the previous one that may be constrained to 3.8 KHZ to 4.2 KHZ, and may be determined in a random fashion. The sine wave signal may then be sent to the analog/high voltage portion of the HVPS and handled just like the monotonic signal found in traditional HVPSs, for example.

FIG. 1 illustrates an exemplary diagram of a printer 100 in accordance with one possible embodiment of the disclosure. The printer 100 may be any device that performs printing of documents, including a printer, a copier, a facsimile (fax) device, or a multi-function device (MFD), for example.

Figure 2:
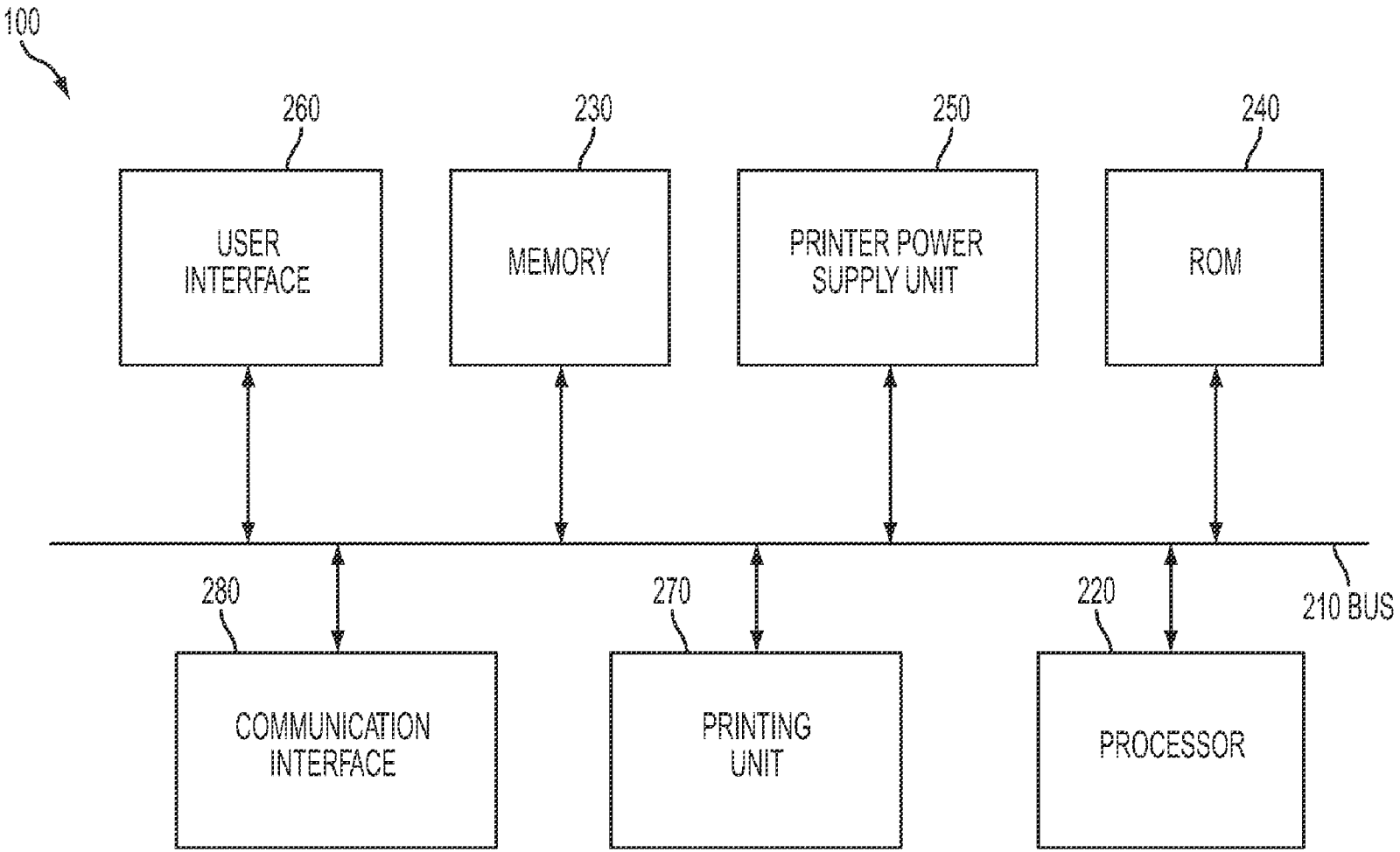
FIG. 2 illustrates a block diagram of an exemplary printer in accordance with one possible embodiment of the disclosure.

FIG. 2 illustrates a block diagram of an exemplary printer 100 in accordance with one possible embodiment of the disclosure. The printer 100 may include may include a bus 210, a processor 220, a memory 230, a read only memory (ROM 240, a printer power supply unit 250, a user interface 260, a printing unit 270, and a communication interface 280. Bus 210 may permit communication among the components of the printer 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User Interface 260 may include one or more conventional mechanisms that permit a user to communicate with the printer 100 and input information, such as a keyboard, a mouse, a pen, a voice recognition device, touchpad, buttons, etc.

Printing unit 270 may include one or more conventional mechanisms that may include any device associated with printing documents, including ink, toner, feeders, fusing units, blades, rollers, output trays, etc., for example.

The printer 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The printer 100 illustrated in FIGS. 1 and 2 and the related discussion are intended to provide a brief, general description of a suitable communication and processing environment in which the invention may be implemented. Although not required, the invention will be described, at least in part, in the general context of computer-executable instructions, such as program modules, being executed by the printer 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the invention may be practiced in communication network environments with many types of communication equipment and computer system configurations, including personal computers, hand-held devices, multi-processor systems, microprocessor-based or programmable consumer electronics, and the like.

The printer power supply unit 250 provides power to the printer and will be described further below with respect to FIG. 3.

Figure 3:
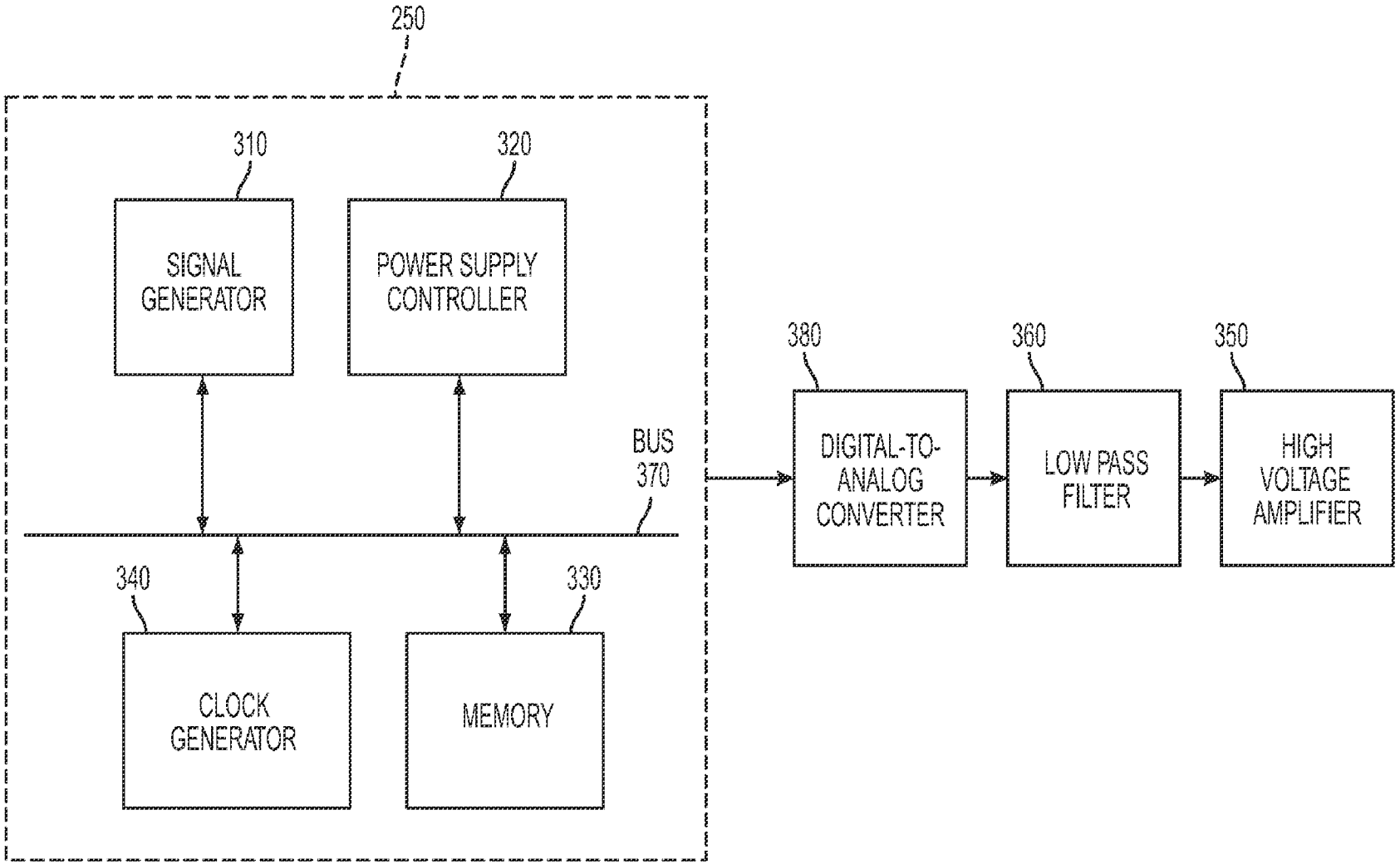
FIG. 3 illustrates a block diagram of an exemplary printer power supply unit in accordance with one possible embodiment of the disclosure.

FIG. 3 illustrates a block diagram of an exemplary printer power supply unit 250 and components other connected thereto in accordance with one possible embodiment of the disclosure. The exemplary power supply unit 250 may include a signal generator 310, a power supply controller 320, a memory 330, and a clock generator 340, connected through the bus 370. The exemplary power supply unit 250 may be connected to a digital-to-analog converter 380, which may be connected a low pass filter 360, which may be then connected to a high voltage amplifier 350.

Bus 370 may permit communication among the components of the printer power supply unit 250. Signal generator 310 may be any electronic device that may generate repeating electrical signals in either the analog or digital domains. Examples of signal generator 310 may include a test signal generator, a function generator, a tone generator, an arbitrary waveform generator, or a frequency generator.

Power supply controller 320 may include at least one conventional controller, processor or microprocessor that interprets and executes instructions. Memory 330 may be a random access memory (RAM) or another type of dynamic storage device that stores information and instructions for execution by the power supply controller 320. Memory 230 may also include a read-only memory (ROM) which may include a conventional ROM device or another type of static storage device that stores static information and instructions for the power supply controller 320.

A clock generator 340 may be any software or hardware circuit that produces a timing signal (known as a clock signal and behaves as such) for use in synchronizing one or more components of the printer power supply unit's 250 operations. The clock signal may range from a simple symmetrical square wave to more complex arrangements. The clock generator 340 may include a resonant circuit, an amplifier, or any other component necessary to generate the desired clock signal.

Digital-to-analog converter 380 may be any known mechanism and/or circuitry that may convert digital signals to analog signals. High voltage amplifier 350 may be any device that changes or (usually) increases, the amplitude of an input signal. Low-pass filter 360 may be any filter that passes all frequencies below its cut-off frequency and rejects those above the cut-off frequency.

Figure 4:
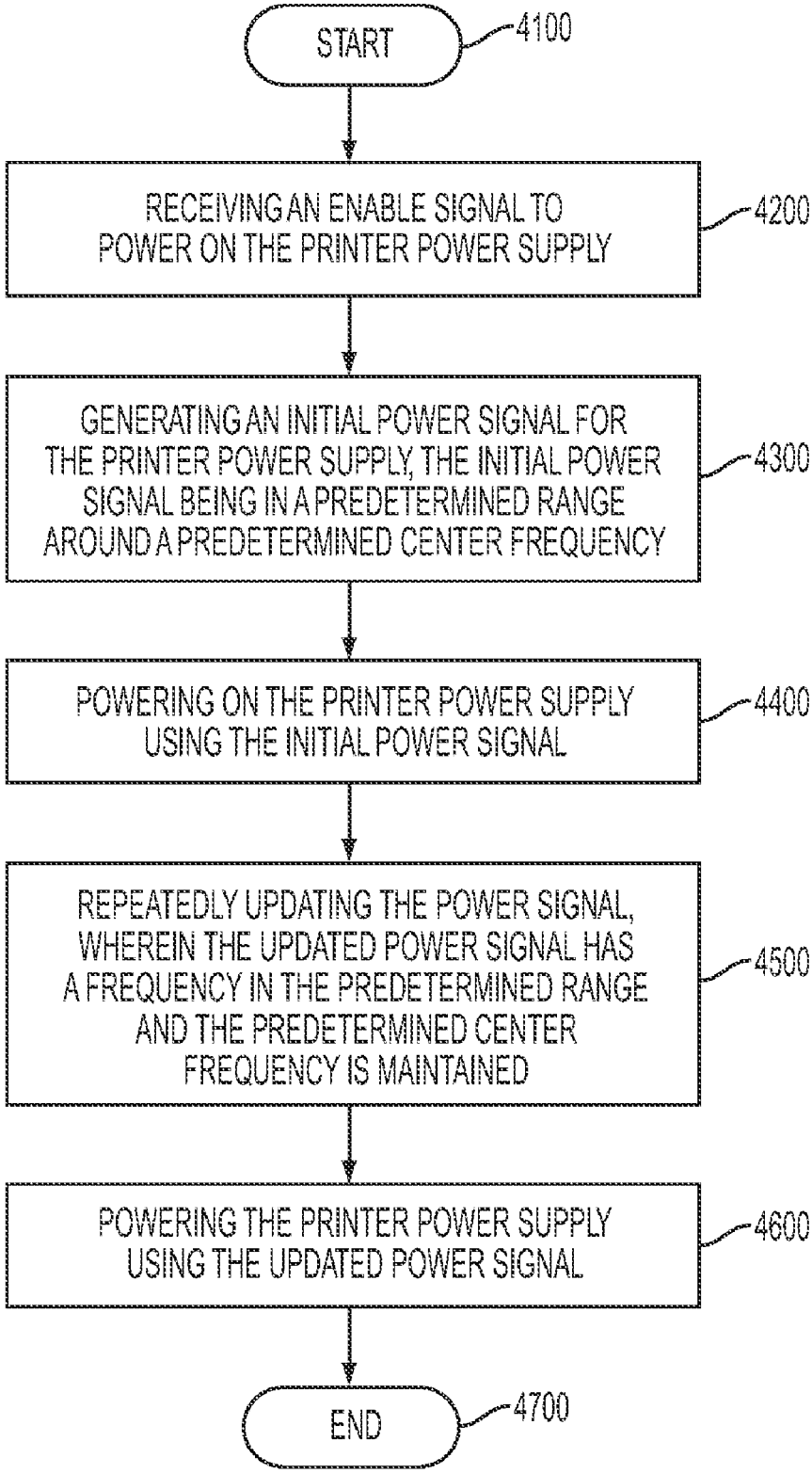
FIG. 4 is a flowchart of an exemplary spread spectrum signal generation process in accordance with one possible embodiment of the disclosure.

For illustrative purposes, the operation of the printer power supply unit 250, and in particular, the power supply controller 320 and signal generator 310 and the spread spectrum signal generation process are described in FIG. 4 in relation to the block diagrams shown in FIGS. 2 and 3.

FIG. 4 is a flowchart of an exemplary spread spectrum signal generation process in accordance with one possible embodiment of the disclosure. The method begins at step 4100, and continues to 4200, where the power supply controller 320 may receive an enable signal to power on the printer power supply unit 250. The enable signal may be generated in response to a user turning on the printer 100, for example.

At step 4300, the signal generator 310 may generate an initial power signal for the printer power supply unit 250 based on the signal received from the power supply controller 320. The initial power signal may be generated in a predetermined range around a predetermined center frequency value provided by the power supply controller 310. The predetermined center frequency value may be set at the factory, at printer setup, or via a user interface prior to printer start-up, for example. The predetermined center frequency value may be set at 4 KHZ, for example. The predetermined frequency range may be any spread spectrum frequency range that may allow the center frequency to be maintained, such as about 3.8 KHZ to about 4.2 KHZ, for example.

At step 4400, the signal generator 310 may power on the printer power supply unit 250 using the generated initial power signal. At step 4500, the power supply controller 250 may repeatedly update the power signal. In this manner, the power signal may be updated as needed, at random, on a periodic basis, etc., for example. If on a periodic basis, the period may range from $1/3800$ second to $1/4200$ second, for example. The updated power signal may have a frequency in the predetermined frequency range and the predetermined center frequency value may be maintained. The updated frequency value may be randomly generated within the frequency range (e.g., 3.8 KHZ to 4.2 KHZ). The updates may take place repeatedly until the power supply unit 250 is powered down.

The updated power signal may be generated by using the clock generator 340 that may generate clock signals. The power supply controller 320 may construct a look-up table for a sine wave for the updated power signal and sequence through the constructed look-up table using the clock generator 340, for example.

The low-pass filter 360 may filter the sine wave signals. The power supply controller 320 may determine an updated frequency of the updated power signal and construct a sine wave for the updated power signal at the determined updated frequency. The power supply controller 320 may determine the updated frequency value using a random number so that the determined updated frequency value would be within the predetermined range, for example. The low-pass filter 360 may filter the constructed sine wave of the updated power signal, and output the filtered constructed sine wave of the updated power signal to the signal generator 310 to power the printer power supply unit 250.

At step 4600, the signal generator 310 may power the printer power supply unit 250 using the updated power signal. The process may then go to step 4700, and end.

Figure 5:
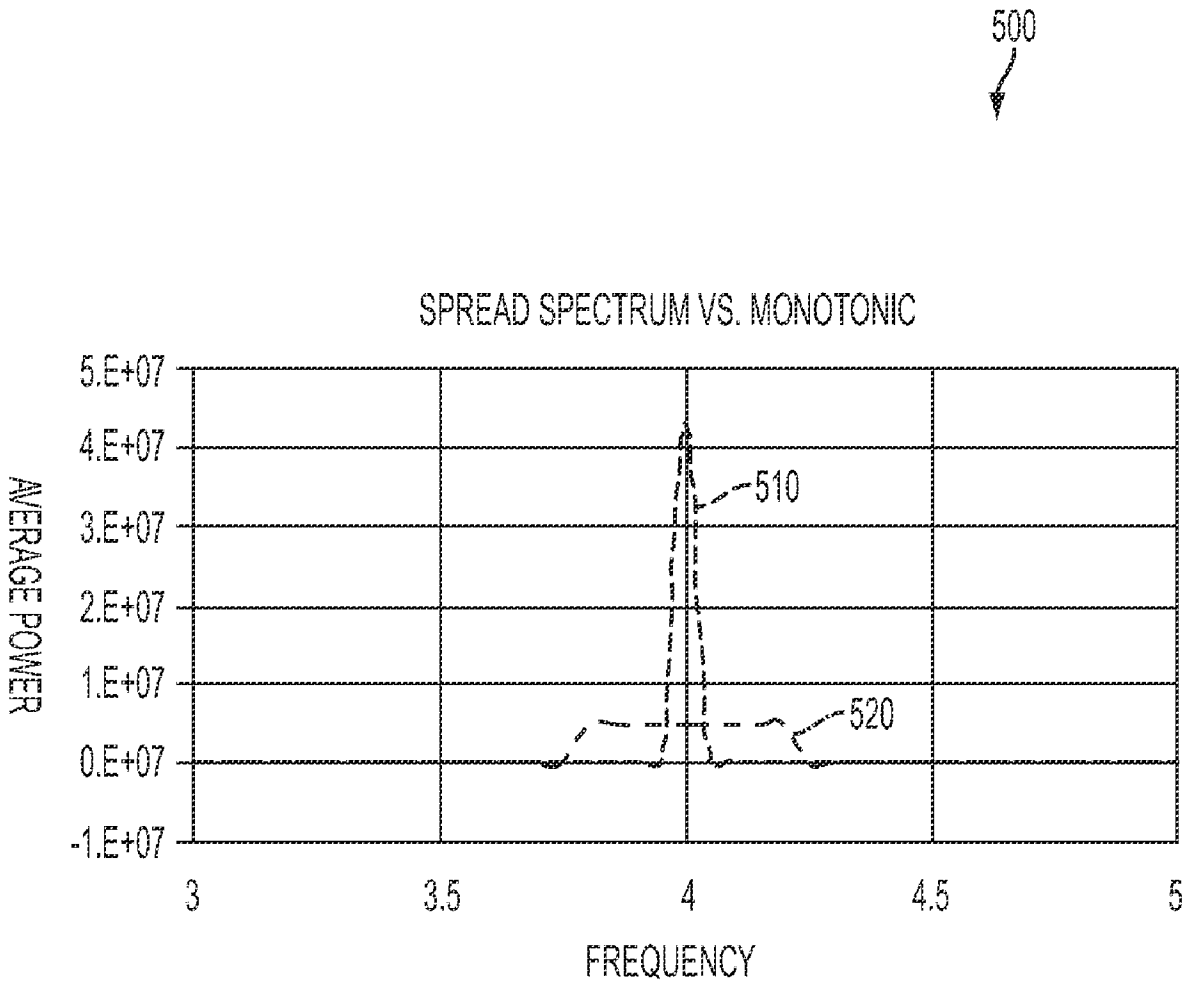
FIG. 5 is an exemplary graph showing the difference between monotonic and spread spectrum signals process in accordance with one possible embodiment of the disclosure.

FIG. 5 is an exemplary graph 500 showing the difference between monotonic and spread spectrum signals process in accordance with one possible embodiment of the disclosure. The graph 500 demonstrates the spectral make-up of two signals. The first signal 510 is a monotonic 4 KHz signal. The second signal 520 is a spread spectrum signal centered around 4 KHz. The total power in the two signals is comparable even though the peak power in the former is much higher at one frequency. The frequency range appears to be about 3.8 KHZ to 4.2 KHZ. However, the center frequency value and frequency range may be other values within the spirit and scope of the invention, for example.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for generating a spread spectrum signal in a printer power supply unit, comprising:

receiving an enable signal to power on the printer power supply unit;

generating a power signal for the printer power supply unit based on the received enable signal, the power signal being generated in a predetermined frequency range around a predetermined center frequency value;

powering on the printer power supply unit using the power signal;

repeatedly updating the power signal, wherein the updated power signal has a frequency value in the predetermined frequency range and the predetermined center frequency value is maintained; and powering the printer power supply unit using the updated power signal.

2. The method of claim 1, wherein the predetermined center frequency value is about 4 KHZ.

3. The method of claim 1, wherein the predetermined frequency range is about 3.8 KHZ to about 4.2 KHZ.

4. The method of claim 1, wherein the power signal and the updated power signals are randomly generated power signals between about 3.8 KHZ and about 4.2 KHZ.

5. The method of claim 1, further comprising:

constructing a look-up table for a sine wave for the updated power signal;

sequencing through the constructed look-up table using a clock generator;

determining an updated frequency value of the updated power signal;

constructing a sine wave for one of the updated power signal at the updated frequency value;

filtering the constructed sine wave of the updated power signal; and outputting the filtered constructed sine wave of the updated power signal to power the printer power supply unit.

6. The method of claim 5, wherein the updated frequency value is determined using a random number so that the updated frequency value would be within the predetermined frequency range.

7. The method of claim 1, wherein the printer is one of a printer, a copier, a facsimile (fax) device, and a multi-function device (MFD).

8. An apparatus that generates a spread spectrum signal in a printer power supply unit, comprising:

a power supply controller that receives an enable signal to power on the printer power supply unit; and a signal generator that generates a power signal for the printer power supply unit based on the signal received from the power supply controller, the power signal being generated in a predetermined range around a predetermined center frequency value provided by the power supply controller, powering on the printer power supply unit using the power signal, wherein the power supply controller repeatedly updates the power signal, the updated power signal having a frequency in the predetermined range and the predetermined center frequency value is maintained, and the signal generator powers the printer power supply unit using the updated power signal.

9. The apparatus of claim 8, wherein the predetermined center frequency value is about 4 KHZ.

10. The apparatus of claim 8, wherein the predetermined range is about 3.8 KHZ to about 4.2 KHZ.

11. The apparatus of claim 8, wherein the signal generator generates the power signal and the updated power signals randomly between about 3.8 KHZ and about 4.2 KHZ.

12. The apparatus of claim 8, further comprising:

a clock generator that generates clock signals, wherein the power supply controller constructs a look-up table for a sine wave for the updated power signal and sequences through the constructed look-up table using the clock generator; and a low-pass filter that filters sine wave signals, wherein the power supply controller determines an updated frequency value of the updated power signal and constructs a sine wave for the updated power signal at the determined updated frequency value, and the low-pass filter filters the constructed sine wave of the updated power signal, and outputs the filtered constructed sine wave of the updated power signal to the signal generator to power the printer power supply unit.

13. The apparatus of claim 12, wherein the power supply controller determines the updated frequency value using a random number so that the updated frequency value would be within the predetermined range.

14. The apparatus of claim 8, wherein the printer is one of a printer, a copier, a facsimile (fax) device, and a multi-function device (MFD).

15. A computer-readable medium storing instructions for controlling a computing device for generating a spread spectrum signal in a printer power supply unit, the instructions comprising:

receiving an enable signal to power on the printer power supply unit;

generating a power signal for the printer power supply unit based on the received enable signal, the power signal being in a predetermined frequency range around a predetermined center frequency value;

powering on the printer power supply unit using the power signal;

repeatedly updating the power signal, wherein the updated power signal has a frequency value in the predetermined range and the predetermined center frequency value is maintained; and powering the printer power supply unit using the updated power signal.

16. The computer-readable medium of claim 15, wherein the predetermined center frequency value is about 4 KHZ.

17. The computer-readable medium of claim 15, wherein the predetermined frequency range is about 3.8 KHZ to about 4.2 KHZ.

18. The computer-readable medium of claim 15, wherein the power signal and the updated power signals are randomly generated power signals between about 3.8 KHZ and about 4.2 KHZ.

19. The computer-readable medium of claim 15, further comprising:

constructing a look-up table for the a sine wave for the updated power signal;

sequencing through the constructed look-up table using a clock generator;

determining an updated frequency value of the updated power signal;

constructing a sine wave for the updated power signal at the updated frequency value;

filtering the constructed sine wave of the updated power signal; and outputting the filtered constructed sine wave of the updated power signal to power the printer power supply unit.

20. The computer-readable medium of claim 19, wherein the updated frequency value is determined using a random number so that the updated frequency value would be within the predetermined frequency range.

21. The computer-readable medium of claim 15, wherein the printer is one of a printer, a copier, a facsimile (fax) device, and a multi-function device (MFD).

* * * * *